US010940696B2

(12) United States Patent
Fujimoto et al.

(10) Patent No.: US 10,940,696 B2
(45) Date of Patent: Mar. 9, 2021

(54) PRINTING APPARATUS AND PRINTING METHOD FOR OBTAINING COLOR DATA DEFINING DISCHARGING/NON-DISCHARGING OF AN INK OF A COLOR TO A PIXEL ON A PRINTING MEDIUM

(71) Applicant: CANON KABUSHIKI KAISHA, Tokyo (JP)

(72) Inventors: Yasunori Fujimoto, Inagi (JP); Hajime Nagai, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/892,128

(22) Filed: Feb. 8, 2018

(65) Prior Publication Data

US 2018/0244071 A1 Aug. 30, 2018

(30) Foreign Application Priority Data

Feb. 27, 2017 (JP) ..... JP2017-035393

(51) Int. Cl.
*B41J 2/21* (2006.01)

(52) U.S. Cl.
CPC ..... *B41J 2/2132* (2013.01)

(58) Field of Classification Search
CPC ..... B41J 2/2132
See application file for complete search history.

(56) References Cited

U.S. PATENT DOCUMENTS 5,975,678 A * 11/1999 Kanematsu ..... B41J 2/2132 347/43
6,343,847 B1 * 2/2002 Torpey ..... B41J 2/2132 347/15
2010/0054586 A1 * 3/2010 Yamazaki ..... G06K 9/342 382/164
2012/0281256 A1 * 11/2012 Sato ..... G03G 15/5087 358/3.29

(Continued)

FOREIGN PATENT DOCUMENTS

JP H07-117331 A 5/1995
JP H07-125406 A 5/1995
JP 9-193529 A 7/1997

(Continued)

*Primary Examiner* — Bradley W Thies
(74) *Attorney, Agent, or Firm* — Canon U.S.A., Inc. IP Division

(57) ABSTRACT

A printing apparatus includes a print head which discharges inks including an ink of a first color and an ink of a second color, an obtaining unit which obtains first color data defining discharging/non-discharging of the ink of the first color to a pixel on a printing medium and second color data defining discharging/non-discharging of the ink of the second color to a pixel on the printing medium, a first determination unit which determines an attribute of an image of a predetermined pixel on the printing medium, a second determination unit which determines whether the predetermined pixel is in a boundary between a region defined to discharge the ink of the first color and a region defined to discharge the ink of the second color or not, and a control unit which controls discharging of the inks based on results of the determinations.

28 Claims, 8 Drawing Sheets

(56) References Cited

U.S. PATENT DOCUMENTS

2013/0187971 A1* 7/2013 Ogata ..... B41J 2/07
347/14
2013/0259364 A1* 10/2013 Shindo ..... G06K 9/4652
382/164

FOREIGN PATENT DOCUMENTS

JP 2002-086707 A 3/2002
JP 2013-166368 A 8/2013

* cited by examiner

FIG. 7A REGION
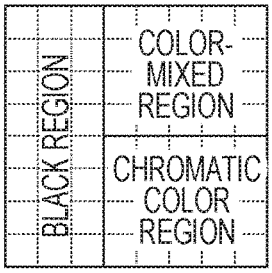
FIG. 7B PURE BLACK ATTRIBUTE
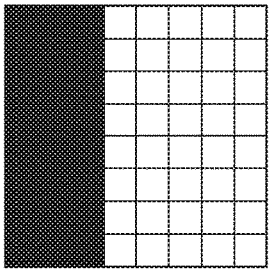
FIG. 7C K QUANTIZED DATA
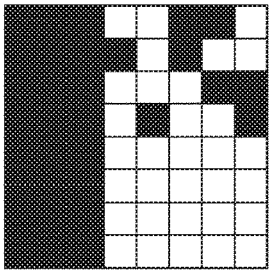
FIG. 7D C QUANTIZED DATA
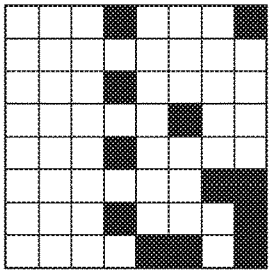
FIG. 7E C BOLD DATA
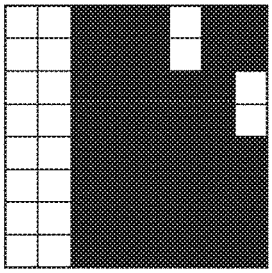
FIG. 7F K QUANTIZED AND C BOLD
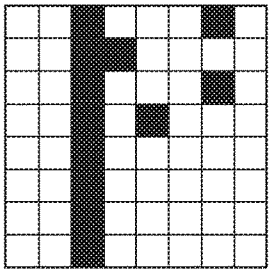
FIG. 7G BLACK/CHROMATIC-COLOR BOUNDARY
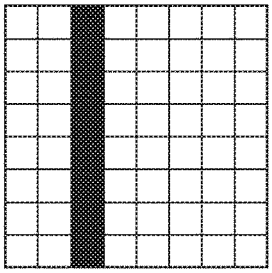
FIG. 7H BLACK INTERNAL REGION
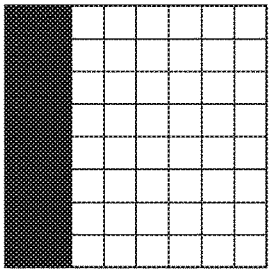
FIG. 7I COLOR-MIXED REGION
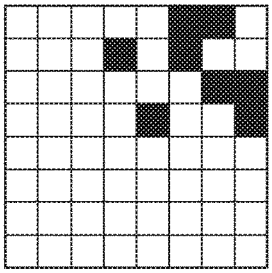
FIG. 7J BOUNDARY + COLOR-MIXED
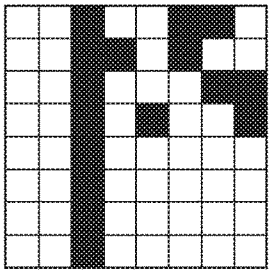

BLACK/CHROMATIC-COLOR BOUNDARY

BLACK INTERNAL REGION

BLACK/CHROMATIC-COLOR BOUNDARY

BLACK INTERNAL+COLOR-MIXED

PRINTING APPARATUS AND PRINTING METHOD FOR OBTAINING COLOR DATA DEFINING DISCHARGING/NON-DISCHARGING OF AN INK OF A COLOR TO A PIXEL ON A PRINTING MEDIUM

BACKGROUND OF THE INVENTION

Field of the Invention

The aspect of the embodiments relates to a printing apparatus and a printing method.

Description of the Related Art

A printing apparatus has been known which relatively scans a print head discharging ink in a scanning direction to discharge ink to a unit region of a printing medium and thus print an image on the unit region. It is also known that such a printing apparatus applies inks of a plurality of colors.

In such a printing apparatus, in a case where inks of a plurality of colors having different surface tensions from each other are applied, ink bleeding may possibly occur due to differences in surface tension between ink droplets of one color provided on a printing medium and ink droplets of another color.

Japanese Patent Laid-Open No. 9-193529 discloses that, in order to reduce bleeding between black and a chromatic color, a boundary between a region printed in black and a region printed in a chromatic color on a printing medium is detected so that different printing methods can be applied between the boundary and the non-boundary region. More specifically, Japanese Patent Laid-Open No. 9-193529 discloses that two types of a first black ink having a higher surface tension than that of a chromatic color ink and a second black ink having a substantially equal surface tension to that of the chromatic color ink are used as black ink and that the second black ink is discharged to the boundary and the first black ink is discharged to the non-boundary region. This can reduce the bleeding because inks having substantially equal surface tensions are in contact with each other in the boundary region between the black and the chromatic color.

Japanese Patent Laid-Open No. 9-193529 further discloses that a position where a pixel for which discharging of a black ink is defined and a pixel for which discharging of a chromatic color ink is defined are adjacent to each other is determined to set the position as a boundary between black and the chromatic color.

However, according to the method disclosed in Japanese Patent Laid-Open No. 9-193529, it may be difficult to determine the boundary between black and a chromatic color.

For example, in a region on a printing medium on which an image (hereinafter, color-mixed image) is to be printed by discharging both of a black ink and a chromatic color ink, print data may possibly be generated which defines ink-discharging to adjacent pixels, more specifically, discharging the black ink to one pixel and discharging the chromatic color ink to the other pixel, based on some input image data or some quantization methods. In this case, the method according to Japanese Patent Laid-Open No. 9-193529 may unintentionally determine those pixels as pixels at a boundary between the black and the chromatic color. Therefore, a printing method for a boundary between the black and the chromatic color may be performed though the pixels are actually in a region printed in color mixture, not in a boundary region between a region printed in the black and a region printed in the chromatic color but.

SUMMARY OF THE INVENTION

A printing apparatus according to an aspect of the embodiments includes a print head configured to discharge a plurality of inks including at least an ink of a first color and an ink of a second color which is different from the first color, an obtaining unit configured to obtain first color data defining discharging or non-discharging of the ink of the first color to a pixel on a printing medium and second color data defining discharging and non-discharging of the ink of the second color to pixels on the printing medium, a first determination unit configured to determine an attribute of an image of a predetermined pixel on the printing medium, a second determination unit configured to determine whether the predetermined pixel is in a boundary between a region defined by the first color data to discharge the ink of the first color and a region defined by the second color data to discharge the ink of the second color or not, and a control unit configured to control discharging of the plurality of inks to the predetermined pixel based on results of the determinations performed by the first and second determination units.

Further features of the disclosure will become apparent from the following description of exemplary embodiments with reference to the attached drawings.

BRIEF DESCRIPTION OF THE DRAWINGS

FIGS. 7A to 7J are explanatory diagrams for a boundary determination example and a printing method example according to an embodiment.

DESCRIPTION OF THE EMBODIMENTS

With reference to drawings, embodiments of the disclosure will be described in detail below.

First Embodiment

Figure 1:
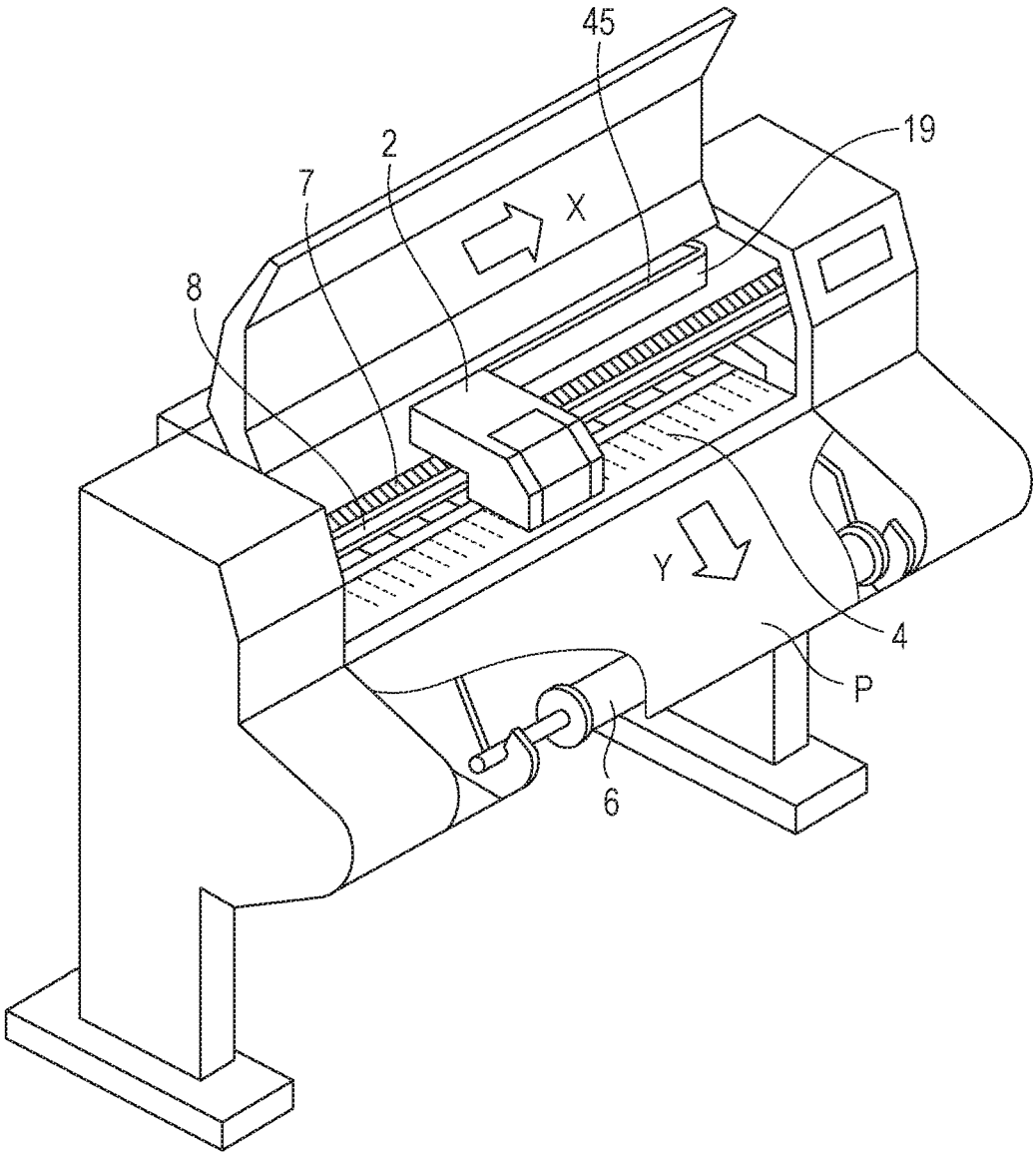
FIG. 1 is a perspective view of a printing apparatus applied in an embodiment.

FIG. 1 illustrates an outer appearance of an ink-jet printing apparatus (hereinafter, also called a printing apparatus or a printer) according to a first embodiment. This may be a so-called serial scan printer which prints an image by scanning a print head in an X direction (scanning direction, a predetermined direction) orthogonal to a Y direction (conveying direction, crossing direction) of a printing medium P.

With reference to FIG. 1, an overview of a configuration of the ink-jet printing apparatus and operations for printing will be described. From a spool 6 holding the printing medium P, the printing medium P is conveyed in the Y direction by a conveying roller driven through a gear by a conveyance motor, not illustrated. On the other hand, a carriage unit 2 at a predetermined conveyed position is scanned (or reciprocally scanned) by a carriage motor, not illustrated, in a forward direction and a backward direction opposite to the forward direction along a guide shaft 8 extending in the X direction. During this scanning, a discharge operation is performed through a discharge port in a print head, which will be described below, mountable to the carriage unit 2 at a time based on a position signal obtained by an encoder 7 so that printing is performed in a predetermined bandwidth corresponding to a range where the discharge port is placed. According to this embodiment, the carriage unit 2 is scanned at a scanning speed of 40 inches per second to perform the discharge operation at a resolution of 600 dpi (1/600 inches). After that, the printing medium P is conveyed, and printing in the next bandwidth is performed thereon. The carriage unit 2 can further be scanned at a speed equal to or higher than 40 inches per second.

A carriage belt can be used for transmitting driving force from the carriage motor to the carriage unit 2. However, instead of a carriage belt, for example, other drive systems can be used which can be driven to rotate by the carriage motor and includes a lead screw extending in the X direction and an engaging portion provided in the carriage unit 2 and engaged with a groove of the lead screw.

The fed printing medium P is pinched and conveyed by a feed roller and a pinch roller to be guided to a printing position (scan region in the print head) on a platen 4. At a normal stop state, because an orifice face of the print head is capped, the cap is opened before printing so that the print head or the carriage unit 2 can get ready for scanning. Then, after data for one scan are buffered, the carriage unit 2 is scanned by the carriage motor to perform the printing as described above.

Here, the following descriptions assume that so-called one-pass printing is to be performed which completes printing after a print head is scanned once on a unit region of the printing medium P. However, so-called multipass printing can be performed in which a plurality of (or n) scans of a print head is performed on a unit region (1/n band) on a printing medium P for printing an image.

Figure 2:
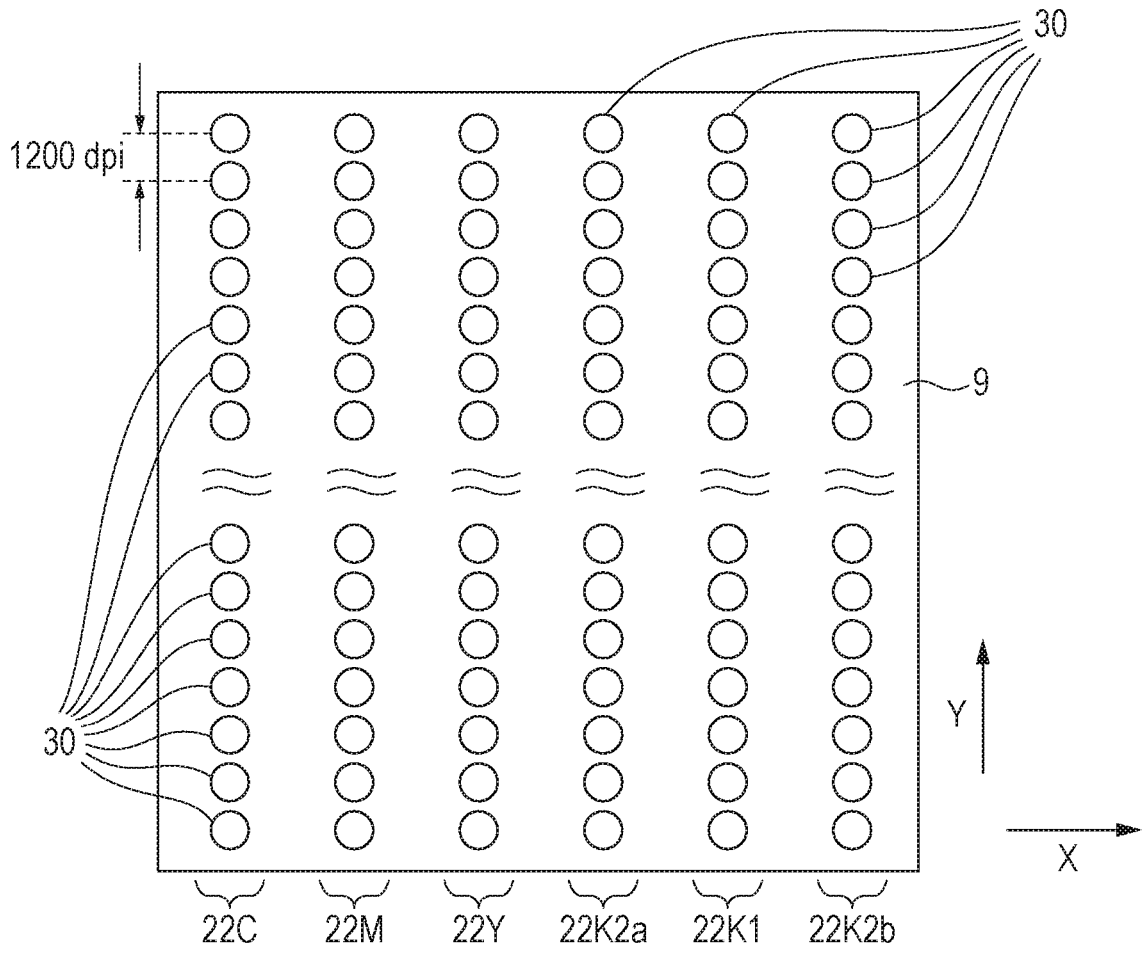
FIG. 2 is a schematic diagram illustrating a print head applied in an embodiment.

FIG. 2 illustrates a print head 9 according to this embodiment. The print head 9 includes a discharge port array 22Y configured to discharge an yellow ink (Y), a discharge port array 22M configured to discharge a magenta ink (M), and a discharge port array 22C configured to discharge a cyan ink (C) where these inks are chromatic inks. The print head 9 further includes a discharge port array 22K2*a* configured to discharge a low permeable black ink (K2), a discharge port array 22K1 configured to discharge a high permeable black ink (K1), and a discharge port array 22K2*b* configured to discharge a low permeable black ink (K2) where these inks are achromatic inks. In the print head 9, the discharge port array 22Y, the discharge port array 22M, the discharge port array 22C, the discharge port array 22K2*a*, the discharge port array 22K1 and the discharge port array 22K2*b* are placed side by side in order from left to right in the X direction.

The discharge port array 22K2*a* and the discharge port array 22Kb can discharge an identical type of low permeable black ink (K2). The high permeable black ink (K1) and the low permeable black ink (K2) are of similar colors having substantially identical hues. The low permeable black ink (K2) has a higher surface tension than that of the high permeable black ink (K1).

Each of the discharge port arrays 22Y, 22M, 22C, 22K2*a*, 22K1, and 22K2*b* has 1280 discharge ports 30 configured to discharge ink and placed at a density of 1200 dpi in the Y direction (arrangement direction). One discharge port 30 according to this embodiment can discharge an amount of ink of about 4.5 pl by one operation.

These discharge port arrays 22Y, 22M, 22C, 22K2*a*, 22K1, and 22K2*b* are connected to an ink tanks, not illustrated, configured to store their corresponding inks and are supplied with the inks. The print head 9 and the ink tanks to be used according to this embodiment may be integrally or separately provided.

Compositions of Inks

Next, compositions of the inks to be used in this embodiment will be described. Hereinafter, terms "part" and "%" are mass references unless otherwise specified. Preparation of High Permeable Black Ink (K1)

(1) Preparation of Dispersion Liquid

First, anionic polymer P-1 [styrene/butylacrylate/acrylic acid copolymer (polymerization ratio (weight ratio)=30/40/30) acid value 202, weight average molecular weight 6500] was prepared. This was neutralized with a potassium hydroxide solution and was diluted with ion exchanged water to prepare a homogeneous 10 mass % polymer solution.

Then, 600 g of the polymer solution, 100 g of carbon black and 300 g of ion exchanged water were blended and were mechanically agitated for a predetermined period of time. Centrifugation processing was performed thereon to remove non-dispersion containing coarse particles and thus obtain black dispersion liquid. The obtained black dispersion liquid had a pigment concentration of 10 mass %.

(2) Preparation of Ink

Ink to be applied in this embodiment was prepared by using the black dispersion liquid. The following components were added to the black dispersion liquid and were sufficiently blended and agitated. Then, the resulting solution undergone pressure filtration with a microfilter (manufactured by Fuji Film) having a pore size of 2.5 μm to prepare pigment ink having a pigment concentration of 5 mass %. In this manner, highly permeable black ink K1 to be applied in this embodiment was prepared.

| | |
|---|---|
| The black dispersion liquid | 50 parts |
| Glycerin | 10 parts |
| Triethylene glycol | 10 parts |
| Acetylene glycol EO adduct 0.5 parts (manufactured by Kawaken Fine Chemicals) | 1.0 parts |
| Ion exchanged water | Balance |

Preparation of Low Permeable Black Ink (K2)

The black dispersion liquid prepared with high permeable black ink was used. The following components were added to the black dispersion liquid and were sufficiently blended and agitated. Then, the resulting solution undergone pressure filtration with a microfilter (manufactured by Fuji Film) having a pore size of 2.5 μm to prepare pigment ink having a pigment concentration of 3 mass %. In this manner, low permeable black ink to be applied to this embodiment was prepared.

| | |
|---|---|
| The black dispersion liquid | 30 parts |
| Glycerin | 10 parts |
| Triethylene glycol | 10 parts |
| 2-Pyrrolidone | 5 parts |
| Acetylene glycol EO adduct 0.5 parts (manufactured by Kawaken Fine Chemicals) | 0.1 parts |
| Ion exchanged water | Balance |

Preparation of Cyan Ink (C)

(1) Preparation of Dispersion Liquid

First, as raw materials and benzyl acrylate and methacrylic acid, by a conventional method, acid value 250, making the AB type block polymer having a number average molecular weight 3000, further, neutralized with potassium hydroxide solution, created a homogeneous 50 mass % polymer solution was diluted with ion-exchanged water.

Then, 200 g of the polymer solution, 100 g of C.I. Pigment Blue 15:3 and 700 g of ion exchanged water were blended and were mechanically agitated for a predetermined period of time. Centrifugation processing was performed thereon to remove non-dispersion containing coarse particles and thus obtain cyan dispersion liquid. The obtained cyan dispersion liquid had a pigment concentration of 10 mass %.

(2) Preparation of Ink

Ink to be applied in this embodiment was prepared by using the cyan dispersion liquid. The following components were added to the cyan dispersion liquid and were sufficiently blended and agitated. Then, the resulting solution undergone pressure filtration with a microfilter (manufactured by Fuji Film) having a pore size of 2.5 μm to prepare pigment ink having a pigment concentration of 2 mass %. In this manner, cyan ink to be applied in this embodiment was prepared.

| | |
|---|---|
| The cyan dispersion liquid | 20 parts |
| Glycerin | 10 parts |
| Diethylene glycol | 10 parts |
| 2-Pyrrolidone | 5 parts |
| Acetylene glycol EO adduct 0.5 parts (manufactured by Kawaken Fine Chemicals) | 1.0 parts |
| Ion exchanged water | Balance |

Preparation of Magenta Ink (M)

(1) Preparation of Dispersion Liquid

First, as raw materials and benzyl acrylate and methacrylic acid, by a conventional method, acid value 300, making the AB type block polymer having a number average molecular weight 2500, further, neutralized with potassium hydroxide solution, created a homogeneous 50 mass % polymer solution was diluted with ion-exchanged water.

Then, 100 g of the polymer solution, 100 g of C.I. Pigment Red 122 and 800 g of ion exchanged water were blended and were mechanically agitated for a predetermined period of time. Centrifugation processing was performed thereon to remove non-dispersion containing coarse particles and thus obtain magenta dispersion liquid. The obtained magenta dispersion liquid had a pigment concentration of 10 mass %.

(2) Preparation of Ink

Ink to be applied in this embodiment was prepared by using the magenta dispersion liquid. The following components were added to the magenta dispersion liquid and were sufficiently blended and agitated. Then, the resulting solution undergone pressure filtration with a microfilter (manufactured by Fuji Film) having a pore size of 2.5 μm to prepare pigment ink having a pigment concentration of 4 mass %. In this manner, magenta ink to be applied in this embodiment was prepared.

| | |
|---|---|
| The magenta dispersion liquid | 40 parts |
| Glycerin | 10 parts |
| Diethylene glycol | 10 parts |
| 2-Pyrrolidone | 5 parts |
| Acetylene glycol EO adduct 0.5 parts (manufactured by Kawaken Fine Chemicals) | 1.0 parts |
| Ion exchanged water | Balance |

Preparation of Yellow Ink (Y)

(1) Preparation of Dispersion Liquid

First, anionic polymer P-1 was neutralized with a potassium hydroxide solution and was diluted with ion exchanged water to prepare a homogeneous 10 mass % polymer solution.

300 g of the polymer solution, 100 g of C.I. Pigment yellow 74 and 600 g of ion exchanged water were blended and were mechanically agitated for a predetermined period of time. Centrifugation processing was performed thereon to remove non-dispersion containing coarse particles and thus obtain yellow dispersion liquid. The obtained yellow dispersion liquid had a pigment concentration of 10 mass %.

(2) Preparation of Ink

The following components were added to the obtained yellow dispersion liquid and were sufficiently blended and agitated to dissolve and disperse. Then, the resulting solution undergone pressure filtration with a microfilter (manufactured by Fuji Film) having a pore size of 1.0 μm to prepare pigment ink having a pigment concentration of 4 mass %. In this manner, yellow ink to be applied in this embodiment was prepared.

| | |
|---|---|
| The Yellow Dispersion Liquid | 40 parts |
| Glycerin | 9 parts |
| Ethylene glycol | 10 parts |
| 2-Pyrrolidone | 5 parts |
| Acetylene glycol EO adduct 0.5 parts (manufactured by Kawaken Fine Chemicals) | 1.0 parts |
| Ion exchanged water | Balance |

Surface Tension of Ink

Among the ink of the colors applied in this embodiment, the low permeable black ink (K2) has a surface tension higher than the surface tensions of the high permeable black ink (K1), cyan ink (C), magenta ink (M), and yellow ink (Y). In this case, the magnitude relationship as described above is satisfied in both of static surface tension and dynamic surface tension.

A static surface tension here can be measured by using an automatic surface tensionmeter CBVP-Z (manufactured by Kyowa Interface Science Co., Ltd.) after the temperatures of the inks are adjusted to 25° C.

On the other hand, the dynamic surface tensions can be measured by adopting the maximum bubble pressure method which forms air bubbles in a fluid and measures an internal pressure change. Bubble Pressure Tesiometer, Model: BP2 may be used as a measurement device therefor. A general dynamic surface tension decreases gradually to a static surface tension value with passage of an interface forming time (an elapsed time from an instance when ink reaches a printing medium). According to this embodiment, a dynamic surface tension was measured where plain paper was used as a printing medium, ink had a temperature of 25° C., and the interface forming time period is 10 [msec].

Table 1 illustrates measurement results of static surface tensions and dynamic surface tensions of the inks of the colors.

TABLE 1

| | Static Surface Tension [mN/m] | Dynamic Surface Tension [mN/m] |
|---|---|---|
| Cyan Ink (C) | 28.5 | 37.9 |
| Magenta Ink (M) | 28.3 | 37.5 |
| Yellow Ink (Y) | 28.6 | 37.3 |
| High Permeable Black Ink (K1) | 28.8 | 38.0 |
| Low Permeable Black Ink (K2) | 39.4 | 60.8 |

Referring to Table 1, among the inks of the colors to be applied in this embodiment, the low permeable black ink has both of a higher static surface tension a higher dynamic surface tension than those of the other inks.

Figure 3:
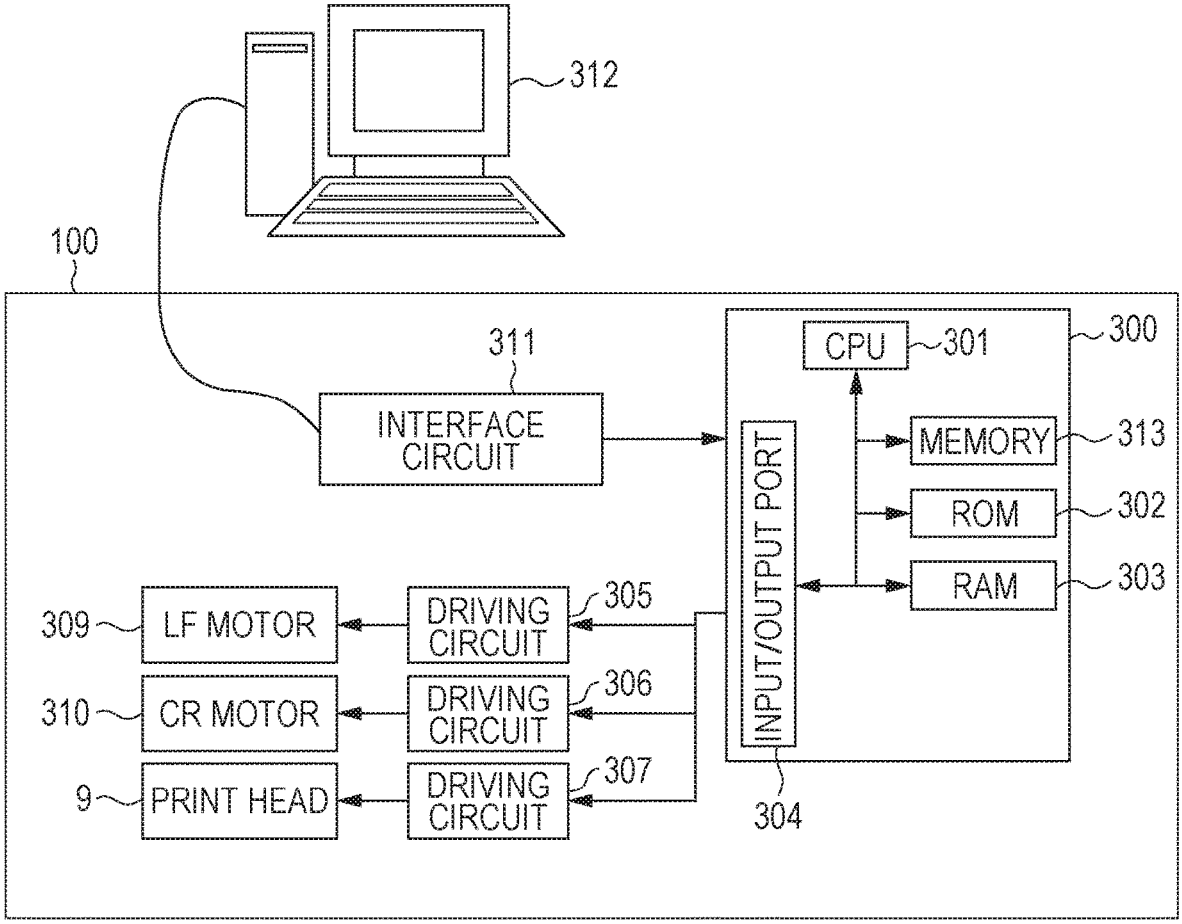
FIG. 3 is a schematic view illustrating print control-related components according to an embodiment.

FIG. 3 is a block diagram illustrating a schematic configuration of control-related components within the printing apparatus 100 according to this embodiment. A main control unit 300 has a CPU 301, a ROM 302, a RAM 303 and an input/output port 304. The CPU 301 is configured to execute processing operations such as calculations, selections, discriminations, and controls and printing operations. The ROM 302 is configured to store a control program to be executed by the CPU 301. The RAM 303 is usable for buffering print data. A memory 313 is configured to store image data, a mask pattern, and a quantization pattern, for example. The input/output port 304 is connected to a conveyance motor (LF motor) 309, a carriage motor (CR motor) 310, and a print head 9 and driving circuits 305, 306, and 307 for actuators in a disconnection unit. The main control unit 300 is further connected to a PC 312 being a host computer through an interface circuit 311.

Data Processing

Figure 4:
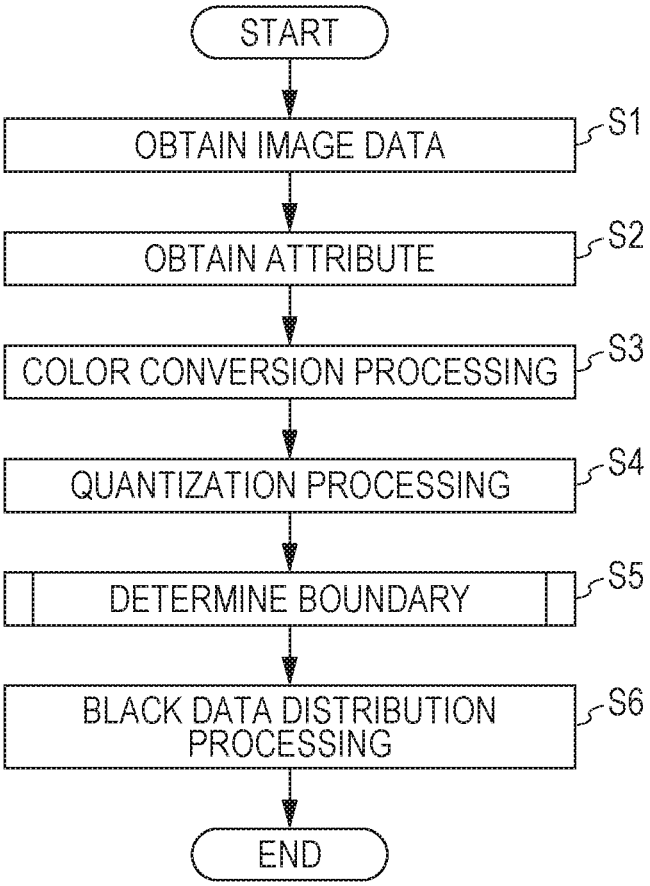
FIG. 4 is a flowchart illustrating steps of image processing according to an embodiment.

FIG. 4 is a flowchart illustrating print data generation processing for printing to be executed by the CPU based on a control program according to this embodiment. For simplicity, hereinafter, a region to be printed in black will be called a black region, a region to be printed in cyan, magenta, and yellow without using black will be called a chromatic color region, and a region to be printed in black and in cyan, magenta, and yellow will be called a color-mixed region.

First, in step S1, the printing apparatus 100 obtains RGB-format image data input from the PC 312 being a host computer.

Next, in step S2, attribute information at each of pixels is obtained based on image data. Here, according to this embodiment, whether an image of the pixel has a pure black attribute or not is determined. More specifically, if image data for the pixel has an RGB value (R,G,B)=(0,0,0), the corresponding image has a pure black attribute. On the other hand, if the image has an RGB value excluding (R,G,B)=(0,0,0), the image is determined as not having the pure black attribute.

Next, in step S3, color conversion processing is performed which converts the RGB-format image data to multi-valued data corresponding to colors (CMYK) of inks to be used for printing. As a result of the color conversion processing, multi-valued data are generated which are represented by 256-value information defining a gray scale of CMYK inks of each of pixel groups each including a plurality of pixels.

Next, in step S4, quantization processing is performed which quantizes the multi-valued data. As a result of the quantization processing, quantized data (ink color data) are generated which are represented by binary information at the pixels. The quantization may be performed by various methods such as dithering processing and error diffusion processing.

Next, in step S5, boundary determination is performed which determines a region having pixels to be printed in black and a boundary region (hereinafter, also called a black/chromatic-color boundary) having pixels to be printed in a chromatic color ink of at least cyan, magenta, and yellow inks. This boundary determination processing will be described in detail below.

Then in step S6, black data distribution processing is performed which distributes the quantized data corresponding to the black ink based on the determination result in step S5 in association with the high permeable black ink (K1) and the low permeable black ink (K2). The black data distribution processing will also be described in detail below.

When the black data distribution processing in step S6 completes, print data is generated which defines discharging/non-discharging of CMYK1K2 inks. Then, the printing is performed by discharging the inks based on the print data. In order to perform multipass printing here, after the black data distribution processing completes, processing may be performed for further dividing data sets corresponding to the inks to a plurality of scans, and the data resulting from the processing may be used as print data.

Having described that the processing in all of S1 to S6 is to be executed by the CPU 301 within the printing apparatus 100, embodiments of the disclosure are not limited thereto. For example, the processing in all of S1 to S6 may be executed by the PC 312. For example, the processing up to the color conversion processing (S3) may be executed by the PC 312, and the processing from the quantization processing (S4) may be executed by the printing apparatus 100.

Boundary Determination

Figure 5:
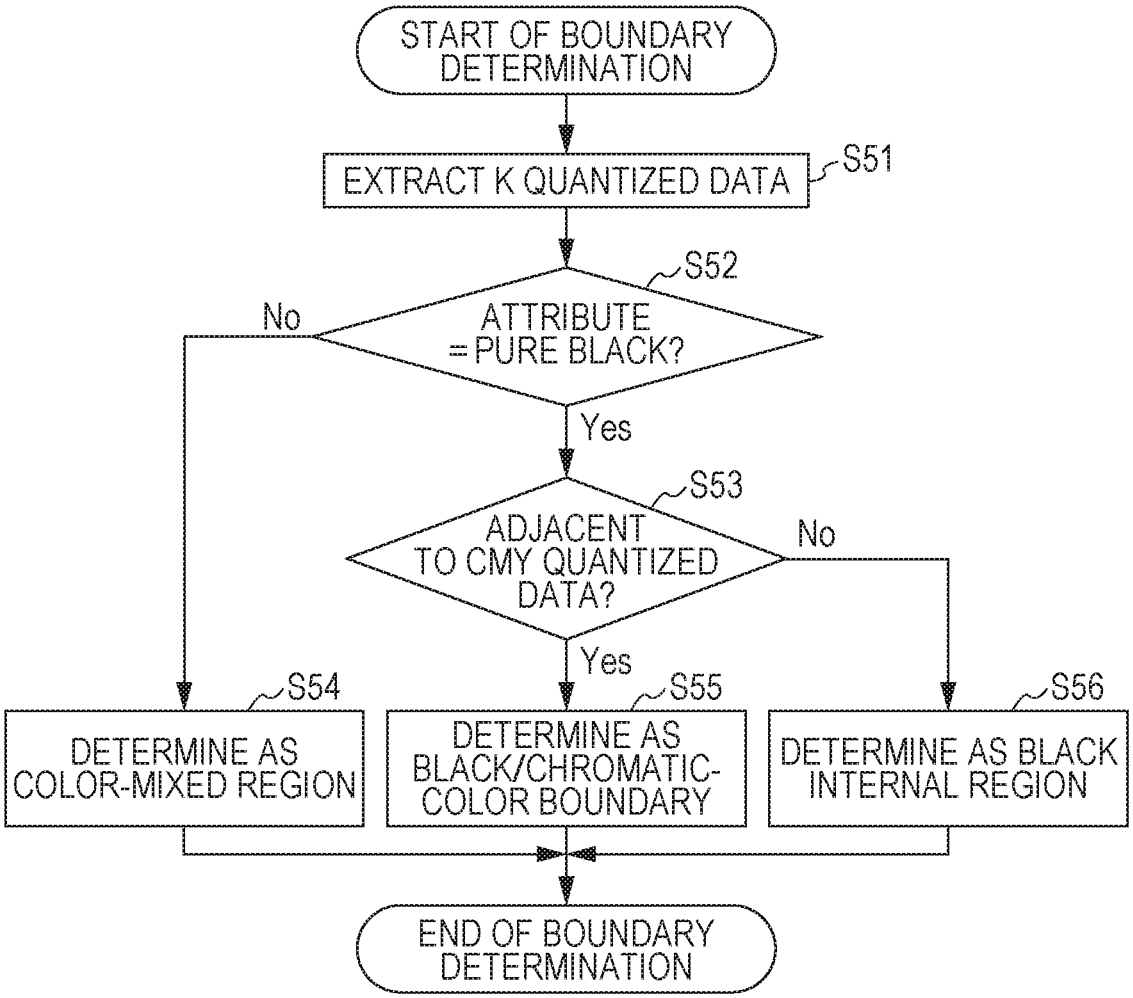
FIG. 5 is a flowchart illustrating steps of boundary determination according to an embodiment.

FIG. 5 is a detail flowchart of the boundary determination to be executed by the CPU based on a control program according to this embodiment.

First, the boundary determination starts, quantized data corresponding to the black ink (hereinafter, also called K quantized data) are extracted from quantized data corresponding to the CMYK inks (step S51).

Next, whether each of the pixels defined in K quantized data to discharge ink has a pure black attribute obtained in step S2 or not is determined (step S52). If it is determined that the pixel has the pure black attribute, the pixel is at least in the black region, and the processing moves to step S53. If it is determined that the pixel does not have the pure black attribute, the processing moves to step S54 where the pixel is in a region not to be printed in black though black ink is defined to be discharged to the pixel (a region not to be printed only in black ink), that is, in a color-mixed region.

Next, a pixel to which ink is defined to be discharged based on the K quantized data is adjacent to a pixel to which inks are defined to be discharged based on the quantized data (hereinafter, also called CMY quantized data) corresponding to cyan, magenta, and yellow inks or not (step S53). If it is determined in step S53 that the pixel is adjacent to the CMY quantized data, the processing moves to step S55 where the pixel is in a black/chromatic-color boundary. If it is determined that the pixel is not adjacent to the CMY quantized data, the processing moves to step S56 where it is determined that the pixel is in a black internal region.

Here, the processing in step S53 according to this embodiment performs bold processing on the CMY quantized data and ANDs the resulting CMY bold data and the K quantized data to determine whether the pixel is adjacent to the CMY quantized data or not.

Figure 6A:
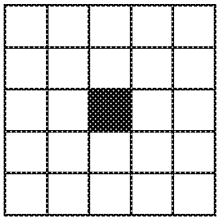
FIGS. 6A to 6D are explanatory diagrams for bold processing according to an embodiment.
Figure 6B:
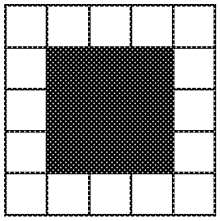

If ink discharging is defined for one pixel, the bold processing extends (or bolds) data to define to discharge ink to pixels around the pixel. According to this embodiment, the data are bolded for surrounding eight pixels. In a case where it is defined to discharge ink to one pixel at a center of a 5-pixel×5-pixel region as illustrated FIG. 6A, the bold processing according to this embodiment may be executed to generate bold data defining to discharge ink to the one pixel at the center and the surrounding eight pixels as illustrated in FIG. 6B.

Figure 6C:
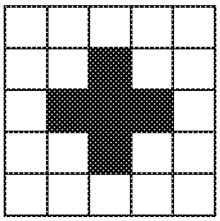
Figure 6D:
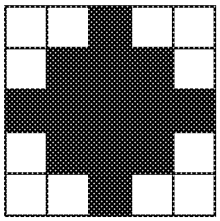

Having described that the surrounding eight pixels are bolded according to this embodiment, any proper different amounts may be bolded. For example, referring to FIG. 6C, one vertical pixel and one horizontal pixel may be bolded without bolding in diagonal directions. The amount to bold may differ among directions, and two vertical pixels and tow horizontal pixels and one pixel in each of diagonal directions may be bolded as illustrated in FIG. 6D.

The thus generated CMY bold data and the K quantized data are ANDed where a pixel to which ink is defined to discharge is determined as the pixel positioned at a boundary and a pixel to which ink is defined not to discharge is determined as a pixel at the non-boundary, that is, a pixel positioned in the internal region.

Here, the CMY bold data corresponds to one of a (1) chromatic color region, a (2) color-mixed region, and a (3) boundary between a region excluding the chromatic color/color-mixed region (or a black region or ink non-discharging region (paper white)) and a chromatic color/color-mixed region. On the other hand, the K quantized data corresponds to one of a (1) black region and a (2) color-mixed region.

A pixel for which ink discharging is defined in the AND of the CMY bold data and the K quantized data corresponds to one of a (1) color-mixed region and a (2) boundary between a black region and a chromatic color/color-mixed region (black/chromatic-color boundary).

The pixels corresponding to the color-mixed region are already excluded in step S52 as described above, processing in step S55 is to be performed only on pixels corresponding to the black/chromatic-color boundary. Processing in step S56 is to be performed on pixels corresponding to a color-mixed region excluded in step S52 of the (1) black region and the (2) color-mixed region corresponding to the K quantized data and pixels corresponding to the black internal region excluding the black/chromatic-color boundary excluded in step S53.

Differentiated Discharging of Black Inks K1 and K2 to Regions

According to this embodiment as described above, whether a black region of each of pixels belongs to one of three of the black internal region, the black/chromatic-color boundary, and the color-mixed region is determined. Based on the results of the determinations, whether the high permeable black ink and the low permeable black ink region are to be discharged is changed for each of the regions. Table 2 illustrates inks to be discharged to the regions according to this embodiment.

TABLE 2

| Black Internal Region | Black/Chromatic-Color Boundary | Color-Mixed Region |
|---|---|---|
| Low Permeable Black Ink K2 | High Permeable Black Ink K1 | High Permeable Black Ink K1 |

According to this embodiment, the low permeable black ink K2 is only used for printing a black internal region. This is because the low permeable black ink K2 has a higher color density than that of a high permeable black K1. Since black may often be used for printing a remarkable region such as a text area in an image, a higher color density may be applied unless it has any adverse effects.

Next, the high permeable black ink K1 is only used for printing a black/chromatic-color boundary. As illustrated in Table 1, the low permeable black ink K2 has a higher surface tension than that of chromatic color ink CMY. Therefore, providing these inks at a position in contact with each other on a printing medium may possibly cause bleeding in which the low permeable black ink K2 flows into a chromatic color ink CMY side because of the difference in surface tension. According to this embodiment, the high permeable black ink K1 is used for printing black/chromatic-color boundary because it has a surface tension substantially equal to that of the chromatic color ink CMY.

The high permeable black ink K1 is only used for printing a color-mixed region. This is because, like a black/chromatic-color boundary, a black ink and a chromatic color ink may be provided at a position where these inks are in contact with each other on a printing medium in the color-mixed region, the resulting bleeding may possibly reduce the image quality. Therefore, like the black/chromatic-color boundary, the high permeable black ink K1 is only used for printing a color-mixed region.

Examples of Boundary Determination and Printing Method

The boundary determination processing and the printing method will be described in detail with reference to example image data. For simplicity, a case will be described where image data corresponding to an 8-pixel×8-pixel region is to be processed. For further simplicity, the following description assumes that a magenta ink and a yellow ink of chromatic color inks are omitted and that a cyan ink is only used as a chromatic color ink.

FIG. 7A schematically illustrates regions described by image data which will be described below. Here, the image data represents 8-pixel×8-pixel region including a left-side 8-pixel×3-pixel region to be printed in black (black region), a lower right 4-pixel×5-pixel region to be printed in a chromatic color (chromatic color region), and an upper right 4-pixel×5-pixel region to be printed in a color mixture of black and chromatic color (color-mixed region).

In a case where image data as schematically illustrated in FIG. 7A is input, the processing in step S2 in FIG. 4 determines that pixels illustrated in FIG. 7B in a black region have a pure black attribute or (R,G,B)=(0,0,0).

After that, the color conversion processing in step S3 is performed, and the quantization processing is performed in step S4. FIG. 7C illustrates K quantized data, which is generated after the quantization processing, representing pixels to which black ink is to be discharged, and FIG. 7D illustrates C quantized data, which is generated after the quantization processing, representing pixels to which a cyan (chromatic color) ink is to be discharged. Because the black ink is only to be discharged to the black region and the color-mixed region, the K quantized data defines to discharge the ink only to the left region and the upper right region as illustrated in FIG. 7C. Because the cyan ink is to be discharged to only the chromatic color region and the color-mixed region, the C quantized data define to discharge the ink to only the lower right region and the upper right region as illustrated in FIG. 7D.

Next, the boundary determination in step S5 is performed where after the K quantized data as illustrated in FIG. 7C is extracted in step S51, whether the attributes of the pixels are the pure black attribute or not is determined in step S52. In step S54, a pixel for which ink discharging is not defined in the K quantized data illustrated in FIG. 7C and which is determined as not having the pure black attribute referring to FIG. 7A is determined as being in the color-mixed region. A pixel satisfying those conditions positions on the upper right side, and the eight pixels illustrated in FIG. 7I are determined as being in the color-mixed region.

Next, in step S53, the bold processing is performed on the C quantized data. Here, the processing bolds the surrounding eight pixels, as described above with reference to FIGS. 6A and 6B. Therefore, performing the bold processing on the C quantized data illustrated in FIG. 7D results in C bold data as illustrated in FIG. 7E.

Next, the K quantized data illustrated in FIG. 7C and the C bold data illustrated in FIG. 7E are ANDed to obtain AND data (K quantized data AND C bold data) as illustrated in FIG. 7F. Pixels having the pure black attribute of the AND data illustrated in FIG. 7F are determined as being in the black/chromatic-color boundary in step S55. The pixels satisfying the condition are vertical eight pixels that are the third pixels from the left end, and the eight pixels illustrated in FIG. 7G are determined as being in the black/chromatic-color boundary.

A pixel which has the pure black attribute illustrated in FIG. 7B and for which the AND data illustrated in FIG. 7F does not define ink discharging is determined as being in the black internal region in step S56. Vertical 16 pixels that are first and second pixels from the left end satisfy the conditions, and the 16 pixels illustrated in FIG. 7H are determined as being in the black internal region.

Thus, whether the pixels for which ink discharging is defined in the K quantized data illustrated in FIG. 8C corresponds to the black/chromatic-color boundary illustrated in FIG. 7G, black internal region illustrated in FIG. 7H, or the color-mixed region illustrated in FIG. 7I is determined. Comparing with FIG. 7A, the regions in FIG. 7A correspond to the regions in FIGS. 7G, 7H, and 7I.

As illustrated in Table 2, according to this embodiment, the K quantized data determined as being in the black internal region and the K quantized data determined as being in the black/chromatic-color boundary and the color-mixed region are distributed in association with the low permeable black ink K2 and the high permeable black ink K1. Therefore, in the example above, the low permeable black ink K2 is discharged to the pixels illustrated in FIG. 7H, the high permeable black ink K1 is discharged to the pixels illustrated in FIG. 7J (AND of the K quantized data in the black/chromatic-color boundary illustrated in FIG. 7G and the K quantized data in the color-mixed region illustrated in FIG. 7I).

According to this embodiment, in the manner as described above, the black/chromatic-color boundary, the black internal region, and the color-mixed region can accurately be determined. The low permeable black ink K2 is applied to the black internal region to increase the color density, and the high permeable black ink K1 is applied to the black/chromatic-color boundary and the color-mixed region to prevent occurrence of bleeding.

Comparison Example

According to a comparison example, whether the pixel for which the K quantized data defines ink-discharging is adjacent to a pixel for which the CMY quantized data defines ink-discharging or not is determined in step S53 in FIG. 5 without performing the determination on whether the attribute is pure black or not in step S52. This comparison example is the same as the first embodiment except that the attribute determination is not performed.

Figure 8A:
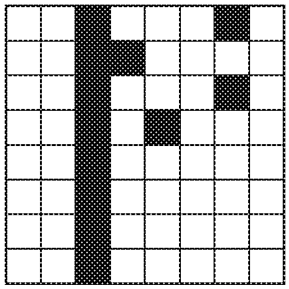
FIGS. 8A and 8B are explanatory diagrams for a boundary determination example and a printing method example according to a comparison embodiment.

Because the comparison as described above does not use the information regarding pixels having the pure black attribute illustrated in FIG. 7B, when the AND data illustrated in FIG. 7F is obtained in step S53, the AND data is directly determined as in the black/chromatic-color boundary as illustrated in FIG. 8A.

Figure 8B:
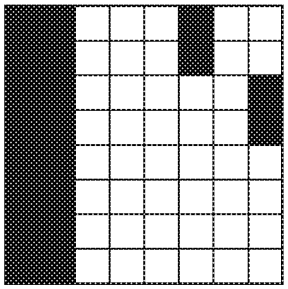

On the other hand, a pixel not in the black/chromatic-color boundary illustrated in FIG. 8A in pixels for which the K quantized data illustrated in FIG. 7C defines ink-discharging is determined as being in the black internal region as illustrated in FIG. 8B.

Here, because the black ink printing method is performed as illustrated in Table 2, this comparison example applies the high permeable black ink K1 to the pixels illustrated in FIG. 8A and the low permeable black ink K2 to the pixels illustrated in FIG. 8B. Comparing with the first embodiment, the first embodiment discharges the low permeable black ink K2 only the 16 pixels at the left end illustrated in FIG. 7H while this comparison example applies the low permeable black ink K2 to the upper right four pixels in addition to the 16 pixels at the left end as illustrated in FIG. 8B.

Comparing between FIG. 8B and FIG. 7A, the comparison example applies the low permeable black ink K2 not only to the black internal region at the left end but also to the color-mixed region on the upper right side. Because the low permeable black ink K2 has a higher surface tension than the other chromatic color inks CMY as described above, applying the low permeable black ink K2 to the color-mixed region may possibly cause bleeding. The comparison example may possibly reduce the image quality without preventing occurrence of bleeding.

This is because, unlike the first embodiment, the comparison example does not determine whether each of pixels has the pure black attribute or not.

The C bold data (FIG. 7E) corresponds to the pixels in the chromatic color region and the color-mixed region in addition to the pixels in the black/chromatic-color boundary. AND data can be obtained by ANDing the C bold data and the K quantized data. Because the K quantized data does not define ink-discharging to the chromatic color region, the AND data does not define ink-discharging to the pixel in the chromatic color region. However, because both of the C bold data and the K quantized data may define ink-discharging to the color-mixed region, the pixels for which the AND data defines ink-discharging may be not only in the black/chromatic-color boundary but also in the color-mixed region.

According to the first embodiment, the pixels (FIG. 7B) determined as having the pure black attribute among the pixels for which the AND data (FIG. 7F) defines ink-discharging are determined as being in the black/chromatic-color boundary. Therefore, only pixels in the black/chromatic-color boundary can be extracted from the AND data. However, according to this comparison example, the result of the determination on whether a pixel has the pure black attribute or not is not used. Therefore, as illustrated in FIG. 8A, not only the pixels in the black/chromatic-color boundary but also partial pixels in the color-mixed region may be disadvantageous determined as being in the black/chromatic-color boundary. This may prevent differentiated discharging (printing (printing method) of the black inks K1 and K2 to the regions.

Second Embodiment

According to the first embodiment, the low permeable black ink K2 is applied only to the black internal region.

According to a second embodiment, on the other hand, both of the high permeable black ink K1 and the low permeable black ink K2 are applied to the black internal region.

Like numbers refer to like parts in the first and second embodiments, and any repetitive description will be omitted.

Table 3 illustrates inks to be discharged to regions according to this embodiment.

TABLE 3

| Black Internal Region | Black/Chromatic-Color Boundary | Color-Mixed Region |
|---|---|---|
| High Permeable Black Ink K1<br>Low Permeable Black Ink K2 | High Permeable Black Ink K1 | High Permeable Black Ink K1 |

Referring to Table 3, like the first embodiment, the high permeable black ink K1 is only applied to the black/chromatic-color boundary and the color-mixed region according to this embodiment.

As illustrated in Table 1, the low permeable black ink K2 has a surface tension higher than not only those of the chromatic color inks CMY but also that of the high permeable black ink K1. Therefore, when only the high permeable black ink K1 is discharged to the black/chromatic-color boundary and only the low permeable black ink K2 is discharged to the black internal region adjacent thereto, bleeding may possibly occur between the high permeable black ink K1 and the low permeable black ink K2.

On the other hand, applying only the high permeable black ink K1 to the black internal region may possibly result in an insufficient color density.

Therefore, according to this embodiment, both of the high permeable black ink K1 and the low permeable black ink K2 are applied to the black internal region. Thus, the occurrence of bleeding can be reduced by maintaining a certain degree of color density with the low permeable black ink K2 and reducing the surface tension with the high permeable black ink K1.

Third Embodiment

According to the first and second embodiments, in order to reduce bleeding, only the high permeable black ink K1 is applied to the color-mixed region.

On the other hand, according to a third embodiment, only the high permeable black ink K1 is applied to the color-mixed region for increasing the color density in the color-mixed region.

Any repetitive descriptions regarding like parts in the first and third embodiments will be omitted.

Table 4 illustrates inks to be discharged to regions according to this embodiment.

TABLE 4

| Black Internal Region | Black/Chromatic-Color Boundary | Color-Mixed Region |
|---|---|---|
| Low Permeable Black Ink K2 | High Permeable Black Ink K1 | Low Permeable Black Ink K2 |

Figure 9A:
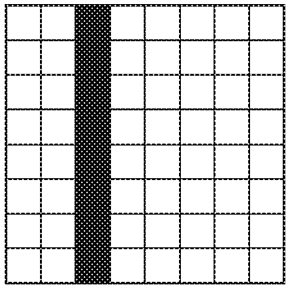
FIGS. 9A and 9B are explanatory diagrams for a printing method example according to an embodiment.
Figure 9B:
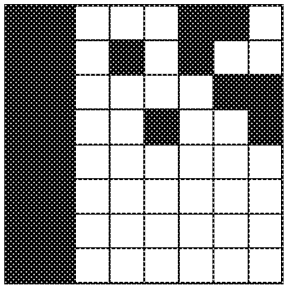

Referring to Table 4, only the high permeable black ink K1 is discharged to the black/chromatic-color boundary according this embodiment. Referring to FIG. 9A, the high permeable black ink K1 is to be discharged to the eight pixels that are the third pixels from the left end, like the pixels in FIG. 7G. On the other hand, because the low permeable black ink K2 is to be discharged to the black internal region and the color-mixed region, the low permeable black ink K2 is to be discharged to the AND of pixels illustrated in FIG. 7H and FIG. 7I for which ink-discharging is defined, as illustrated in FIG. 9B.

According to this embodiment, in order to increase the color density in the color-mixed region, only the low permeable black ink K2 is applied to the color-mixed region for printing. This is because this embodiment puts emphasis more on the density of black in the color-mixed region than on the reduction of the image quality due to bleeding.

Discharging the low permeable black ink K2 enables printing of an image having a higher density of black in the color-mixed region.

Fourth Embodiment

According to a fourth embodiment, in combination with the third embodiment, both of the high permeable black ink K1 and the low permeable black ink K2 are discharged to the black internal region, like the second embodiment.

Any repetitive descriptions regarding like parts in the first to third embodiments will be omitted.

Table 5 illustrates inks to be discharged to regions according to this embodiment.

TABLE 5

| Black Internal Region | Black/Chromatic-Color Boundary | Color-Mixed Region |
|---|---|---|
| High Permeable Black Ink K1<br>Low Permeable Black Ink K2 | High Permeable Black Ink K1 | Low Permeable Black Ink K2 |

Referring to Table 5, according to this embodiment, only the high permeable black ink K1 is discharged to the black/chromatic-color boundary, and only the low permeable black ink K2 is discharged to the color-mixed region, like the third embodiment.

On the other hand, both of the high permeable black ink K1 and the low permeable black ink K2 are discharged to the black internal region. This can advantageously reduce bleeding between the black internal region and the black/chromatic-color boundary, like the second embodiment.

Other Embodiments

Having described the determination of a pixel of (R,G,B)=(0,0,0) as having a pure black attribute according to the aforementioned embodiments, the determination may be performed in any other manners. For example, a pixel having the pure black attribute may be determined even if RGB components have a value equal to or higher than one to a certain extent. For example, if a maximum value of RGB values is equal to 255, a pixel satisfying a condition R+G+B<3 may be determined as having the pure black attribute. In this case, a pixel of (R,G,B)=(0,0,1), (1,1,0) or the like may be determined as having a pure black attribute.

Having described that, according to the aforementioned embodiments, RGB values before the color conversion processing are used for determining whether the pixel has the pure black attribute or not, CMYK values after the color conversion processing may be used for the determination. In this case, for example, if a maximum value of the CMYK values is equal to 255, a pixel of (C,M,Y,K)=(0,0,0,255) may only be determined as having the pure black attribute. For example, a pixel satisfying conditions C+M+Y<3 and K>252 may be determined as having the pure black attribute.

A decrease of image quality due to a decrease of the color density in a text area in black may be easily remarkable in an actual image. Therefore, in addition to the aforementioned embodiments, whether a pixel is in a text area or not may further be determined, and if it is determined the corresponding AND data defines ink-discharging to the pixel and that the pixel has the pure black attribute, the low permeable black ink K2 may be discharged only to the pixel.

Having described that, according to the aforementioned embodiments, a low permeable black ink has a larger static surface tension and a larger dynamic surface tension that those of a high permeable black ink, the effects provided by any one of the aforementioned embodiments may be provided if at least one of the surface tensions is larger.

Having described that, according to the aforementioned embodiments, two types of black ink including the high permeable black ink K1 and the low permeable black ink K2 are provided, the effects provided by any one of the aforementioned embodiments may be provided if two types of black inks are of similar colors and have surface tensions different from each other. The two types of black inks are not necessary, but two types of a high permeable magenta ink and a low permeable magenta ink may be used. In this case, as in the aforementioned embodiments, quantized data corresponding to the magenta inks may be defined separately for three of internal region to be printed in magenta (corresponding to the black internal region according to the embodiments), a boundary between the region to be printed in magenta and a region to be printed in another color (corresponding to the black/chromatic-color boundary according to the embodiments), and a region to be printed in a color mixture of magenta and the other color (corresponding to the color-mixed region according to the embodiment). The printing method with the high permeable magenta ink and the low permeable magenta ink may be differentiated among the three regions so that the same effects as those of the embodiments can be provided.

Having described that, according to the aforementioned embodiments, the printing apparatus and the printing method using the printing apparatus, embodiments of the disclosure are applicable to an image processing apparatus or an image processing method for generating data for performing the printing method according to the aforementioned embodiments. Embodiments of the disclosure are also applicable to an implementation in which a program for executing the printing method according to the aforementioned embodiments is provided in a separate apparatus from the printing apparatus.

According to the printing apparatus of the disclosure, a boundary between regions to be printed in different colors can be determined.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-035393 filed Feb. 27, 2017, which is hereby incorporated by reference herein in its entirety.

What is claimed is:

1. A printing apparatus comprising:

a print unit configured to discharge a chromatic color ink and achromatic color inks, the achromatic color inks including a first achromatic color ink, and a second achromatic color ink having a higher surface tension than that of the first achromatic color ink to a printing medium;

an obtaining unit configured to obtain image data to be printed on the printing medium;

a determination unit configured to determine whether each of a plurality of pixels is a pure black pixel corresponding to a predetermined achromatic color based on the image data; and a control unit configured to control discharging of the chromatic color ink, the first achromatic color ink, and the second achromatic color ink to a plurality of unit areas on the printing medium, in such a manner that (A) the first achromatic color ink is discharged for a unit area that corresponds to a pixel determined as the pure black pixel and is adjacent to an area to which the chromatic color ink is discharged, (B) the second achromatic color ink is discharged for a unit area that corresponds to a pixel determined as the pure black pixel and is not adjacent to an area to which the chromatic color ink is discharged, and (C) the first achromatic color ink is discharged for a unit area that corresponds to a pixel determined as not the pure black pixel, but the second achromatic color ink is not discharged for the unit area that corresponds to the pixel determined as not the pure black pixel.

2. The printing apparatus according to claim 1, wherein the control unit controls the discharging of the first achromatic color ink, the second achromatic color ink, and the chromatic color ink so as not to discharge the first achromatic color ink to the unit area that corresponds to the pixel determined as the pure black pixel and is not adjacent to an area to which the chromatic color ink is discharged.

3. The printing apparatus according to claim 1, wherein the control unit controls the discharging of the first achromatic color ink, the second achromatic color ink, and the chromatic color ink so as not to discharge the second achromatic color ink to the unit area that corresponds to a pixel determined as the pure black pixel and is adjacent to an area to which the chromatic color ink is discharged.

4. The printing apparatus according to claim 1, wherein the control unit controls the discharging of the first achromatic color ink, the second achromatic color ink, and the chromatic color ink so as not to discharge the chromatic color ink to the unit area that corresponds to the pixel determined as the pure black pixel.

5. The printing apparatus according to claim 1, wherein the image data obtained by the obtaining unit is data in an RGB format.

6. The printing apparatus according to claim 5, wherein the determination unit determines a pixel representing (R,G, B)=(0,0,0) as the pure black pixel.

7. The printing apparatus according to claim 5, wherein the determination unit determines a pixel satisfying the inequality R+G+B<3, where maximum values of the respective RGB values of the image data are 255, as the pure black pixel.

8. The printing apparatus according to claim 5, wherein the image data is data in a CMYK format, and wherein the determination unit determines a pixel satisfying the inequalities C+M+Y<3 and K>252, where maximum values of the respective CMYK values of the image data are 255, as the pure black pixel.

9. The printing apparatus according to claim 1, wherein the image data obtained by the obtaining unit is data corresponding to each of the plurality of color inks used by the print unit.

10. The printing apparatus according to claim 1, wherein the control unit determines whether each of the unit areas that correspond to the pixels determined as the pure black pixels is adjacent to the area to which the chromatic color ink is discharged or not adjacent to the area to which the chromatic color ink is discharged by performing bold processing on the chromatic color data to generate bold data and ANDing the bold data and the achromatic color data.

11. The printing apparatus according to claim 1, wherein the control unit controls the print unit based on quantized image data.

12. The printing apparatus according to claim 1, wherein a permeability of the first achromatic color ink is higher than a permeability of the second achromatic color ink.

13. The printing apparatus according to claim 1, wherein the control unit controls the discharging of the first achromatic color ink, the second achromatic color ink, and the chromatic color ink so as not to discharge the second achromatic color ink to the unit area that corresponds to a pixel determined as the pure black pixel and is adjacent to an area to which the chromatic color ink is discharged.

14. The printing apparatus according to claim 1, wherein the first achromatic color ink is discharged for all of unit areas that correspond to the pixel determined as not the pure black pixel, but the second achromatic color ink is discharged for none of the unit areas that correspond to the pixel determined as not the pure black pixel.

15. An image processing apparatus for discharging a chromatic color ink and achromatic color inks, the achromatic color inks including a first achromatic color ink and a second achromatic color ink having a higher surface tension than that of the first achromatic color ink to a printing medium, the image processing apparatus comprising:

an obtaining unit configured to obtain image data to be printed on the printing medium;

a determination unit configured to determine whether each of a plurality of pixels is a pure black pixel corresponding to a predetermined achromatic color based on the achromatic color data; [support: paragraph 0060, S52 in FIG. 5] and a generating unit configured to generate a first achromatic data corresponding to the first achromatic color ink and a second achromatic data corresponding to the second achromatic color ink in such a manner that, discharging of the first achromatic color ink is defined for the determined pure black pixel adjacent to a pixel to which the chromatic color ink is defined to be discharged, discharging of the second achromatic color ink is defined for the determined pure black pixel not adjacent to a pixel to which the chromatic color ink is defined to be discharged, and the first achromatic color ink is used for the pixel determined as not the pure black pixel, but the second achromatic color ink is not used for the pixel determined as not the pure black pixel.

16. A printing apparatus comprising:

a print unit configured to discharge a chromatic color ink and achromatic color inks, the achromatic color inks including a first achromatic color ink, and a second achromatic color ink having a higher surface tension than that of the first achromatic color ink to a printing medium;

an obtaining unit configured to obtain image data to be printed on the printing medium;

a determination unit configured to determine whether each of a plurality of pixels is a pure black pixel corresponding to a predetermined achromatic color based on the image data; and a control unit configured to control discharging of the chromatic color ink, the first achromatic color ink, and the second achromatic color ink to a plurality of unit areas on the printing medium, in such a manner that (A) the first achromatic color ink is discharged for a unit area that corresponds to a pixel determined as the pure black pixel and is adjacent to an area to which the chromatic color ink is discharged, (B) the second achromatic color ink is discharged for a unit area that corresponds to a pixel determined as the pure black pixel and is not adjacent to an area to which the chromatic color ink is discharged, and (C) the second achromatic color ink is discharged for a unit area that corresponds to a pixel determined as not the pure black pixel, but the first achromatic color ink is not discharged for the unit area that corresponds to the pixel determined as not the pure black pixel.

17. The printing apparatus according to claim 16, wherein the control unit controls the discharging of the first achromatic color ink, the second achromatic color ink, and the chromatic color ink so as not to discharge the first achromatic color ink to the unit area that corresponds to the pixel determined as the pure black pixel and is not adjacent to an area to which the chromatic color ink is discharged.

18. The printing apparatus according to claim 16, wherein the control unit controls the discharging of the first achromatic color ink, the second achromatic color ink, and the chromatic color ink so as not to discharge the chromatic color ink to the unit area that corresponds to the pixel determined as the pure black pixel.

19. The printing apparatus according to claim 16, wherein the image data obtained by the obtaining unit is data in an RGB format.

20. The printing apparatus according to claim 19, wherein the determination unit determines a pixel representing (R,G, B)=(0,0,0) as the pure black pixel.

21. The printing apparatus according to claim 19, wherein the determination unit determines a pixel satisfying the inequality R+G+B<3, where maximum values of the respective RGB values of the image data are 255, as the pure black pixel.

22. The printing apparatus according to claim 19, wherein the image data is data in a CMYK format, and wherein the determination unit determines a pixel satisfying the inequalities C+M+Y<3 and K>252, where maximum values of the respective CMYK values of the image data are 255, as the pure black pixel.

23. The printing apparatus according to claim 16, wherein the image data obtained by the obtaining unit is data corresponding to each of the plurality of color inks used by the print unit.

24. The printing apparatus according to claim 16, wherein the control unit determines whether each of the unit areas that correspond to the pixels determined as the pure black pixels is adjacent to the area to which the chromatic color ink is discharged or not adjacent to the area to which the chromatic color ink is discharged by performing bold processing on the chromatic color data to generate bold data and ANDing the bold data and the achromatic color data.

25. The printing apparatus according to claim 16, wherein the control unit controls the print unit based on quantized image data.

26. The printing apparatus according to claim 16, wherein a permeability of the first achromatic color ink is higher than a permeability of the second achromatic color ink.

27. The printing apparatus according to claim 16, wherein the second achromatic color ink is discharged for all of unit areas that correspond to the pixel determined as not the pure black pixel, but the first achromatic color ink is discharged for none of the unit areas that correspond to the pixel determined as not the pure black pixel.

28. An image processing apparatus for discharging a chromatic color ink and achromatic color inks, the achromatic color inks including a first achromatic color ink and a second achromatic color ink having a higher surface tension than that of the first achromatic color ink to a printing medium, the image processing apparatus comprising:

an obtaining unit configured to obtain image data to be printed on the printing medium;

a determination unit configured to determine whether each of a plurality of pixels is a pure black pixel corresponding to a predetermined achromatic color based on the achromatic color data; and a generating unit configured to generate a first achromatic data corresponding to the first achromatic color ink and a second achromatic data corresponding to the second achromatic color ink in such a manner that, discharging of the first achromatic color ink is defined for the determined pure black pixel adjacent to a pixel to which the chromatic color ink is defined to be discharged, discharging of the second achromatic color ink is defined for the determined pure black pixel not adjacent to a pixel to which the chromatic color ink is defined to be discharged, and the second achromatic color ink is used for the pixel determined as not the pure black pixel, but the first achromatic color ink is not used for the pixel determined as not the pure black pixel.

* * * * *